United States Patent [19]

Krob

[11] 4,216,976

[45] Aug. 12, 1980

[54] HEEL-RELEASE BINDING WITH A COUPLED SKI BRAKE

[75] Inventor: Erwin Krob, Vienna, Austria

[73] Assignee: TMC Corporation, Baar, Switzerland

[21] Appl. No.: 911,799

[22] Filed: Jun. 2, 1978

[30] Foreign Application Priority Data

Jun. 16, 1977 [AT] Austria ..... 4260/77

[51] Int. Cl.[2] ..... A63C 7/10

[52] U.S. Cl. ..... 280/605

[58] Field of Search ..... 280/605, 604, 617, 618, 280/632; 188/5, 7

[56] References Cited

U.S. PATENT DOCUMENTS 4,061,356 12/1977 Salomon ..... 280/605

FOREIGN PATENT DOCUMENTS 2535552 2/1977 Fed. Rep. of Germany ..... 280/605
2628005 2/1977 Fed. Rep. of Germany ..... 280/605
2726023 3/1978 Fed. Rep. of Germany ..... 280/605
2278363 3/1974 France ..... 280/605

*Primary Examiner*—Robert B. Reeves
*Assistant Examiner*—Gene A. Church
*Attorney, Agent, or Firm*—Blanchard, Flynn, Thiel, Boutell & Tanis

[57] ABSTRACT

A heel-release binding pivotally secured to a base plate which is in turn slidable on a set of rails fixedly secured to the upper surface of a ski along the longitudinal axis of the ski. A ski brake is pivotally secured to the base plate and is movable therewith. The axles supporting the ski brake for pivotal movement extend inwardly of the base plate. Notches are provided in each of the rails on the ski to facilitate the movement of the base plate longitudinally of the ski. A support flange is provided on the heel-release binding and is positioned to be engaged by the holding arms of the ski brake only when the holding arms are urged from the upright braking position toward the retracted downhill position. The holding arms are readily pivotal between the retracted position and the braking position without necessarily requiring a pivotal movement of the heel-release binding when the ski boot is not engaged with the heel-release binding.

4 Claims, 4 Drawing Figures

Fig. 1
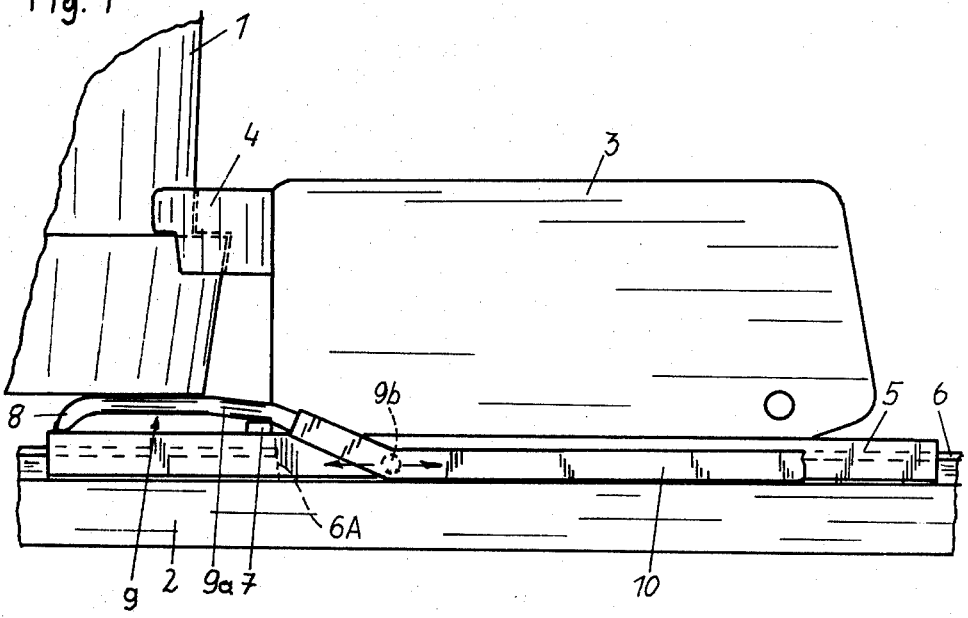
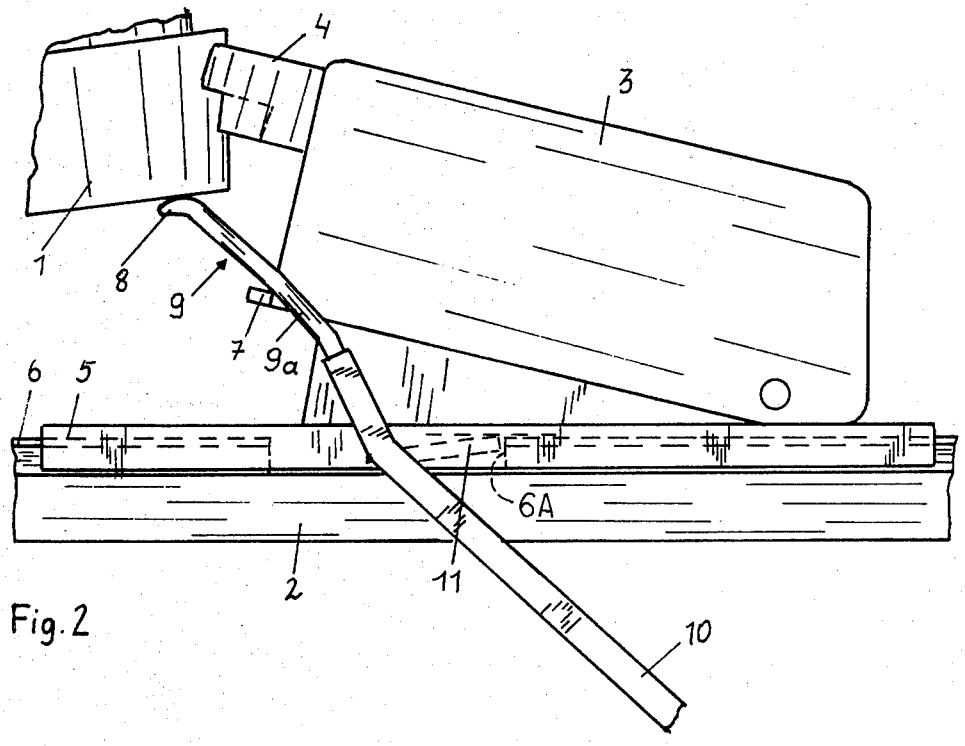
Fig. 2

HEEL-RELEASE BINDING WITH A COUPLED SKI BRAKE

FIELD OF THE INVENTION

The invention relates to a heel-release binding having a coupled ski brake.

BACKGROUND OF THE INVENTION

Coupled ski binding elements and ski brakes are generally provided in order to overcome disadvantages created during installation of a separate ski brake and separate binding elements. During insertion of the ski boot into the ski binding, the stepping plates, stepping cams or the like of both the ski brake and also the heel-release binding must be operated correctly, which often, however, results in difficulties because during the installation of the binding parts these must be mounted separately on the ski.

Thus, for example from German OS No. 25 32 736, published Feb. 2, 1977, a heel-release binding which is coupled with a ski brake has become known, in which the braking members are hingedly connected to a part of the heel-release binding, which part carries out a tilting movement, and is thus swivelled during release of the heel-release binding into its braking position.

Such a construction, however, has the important disadvantage that during a release of the front jaw of the ski binding the braking members are not operated and remain in the rest position, because the heel-release jaw is not opened.

To avoid this disadvantage it has become known from German OS No. 25 35 552, published Feb. 17, 1977, to couple a heel-release binding with a ski brake, which heel-release binding carries out during insertion of the ski boot into the ski binding both a tilting and also a longitudinal thrust movement. A guide plate is mounted for this purpose on the part of the automatically operated heel which carries out the longitudinal thrust and also the tilting movement, which guide plate releases during removal of the ski boot from the ski binding and during upward tilting of the ski binding part or during the longitudinal movement of the same a spring-loaded braking member. Such a construction, however, has the disadvantage that a heel-release binding which carries out a longitudinal thrust movement must be used, and that upon an adjustment of the ski binding to a different boot size, the guide plate must be newly adjusted.

Accordingly, the basic purpose of the invention is to provide a heel-release binding having a ski brake coupled thereto, which can be manufactured in an economical manner and which at all times assures without limitation to certain types of heel-release bindings, that also during an opening of the front jaw the ski brake becomes effective.

The basic purpose of the invention is achieved by the ski brake having an operating element, which can be pressed down by the ski boot, and that the ski brake is connected to the heel-release binding through a support flange which closes the heel-release binding during a swivelling of the ski brake from the braking position into the downhill position.

Through this inventive construction it is made possible that the heel-release binding no longer requires a separate stepping plate or stepping cam, but is carried along and closed automatically during operation of the ski brake by the ski boot of the heel-release jaws. During an opening of the front jaw, however, it is made possible by the inventive construction of the support flange which is effective only during closing, that the ski brake swings into its braking position. It is hereby advantageous if the ski brake has at least one operating arm which is connected to the braking member, in the path of swing of which operating arm there lies a support flange which is provided on the heel-release binding.

BRIEF DESCRIPTION OF THE DRAWINGS

The invention will be discussed more in detail hereinafter with reference to an exemplary embodiment and with reference to the drawing figures, which reference is not to infer any limiting meaning.

FIG. 1 illustrates the heel-release binding having a coupled ski brake in the downhill position;

FIG. 2 illustrates the heel-release binding in the open position during stepping of the skier into the binding;

DETAILED DESCRIPTION

Figure 3:
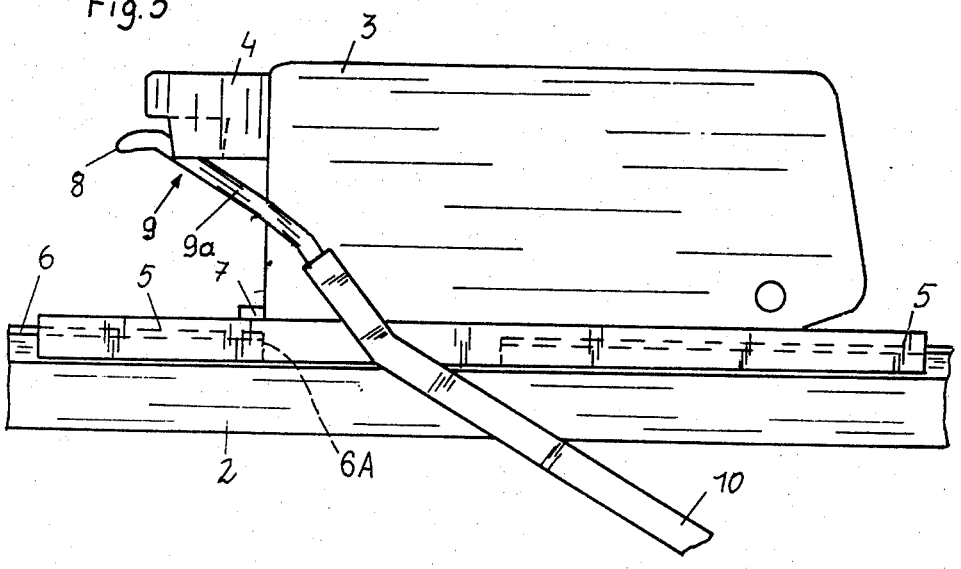
FIG. 3 illustrates the heel-release binding in the closed position with the ski brake being in the braking position.

The heel-release binding which is illustrated in the downhill position in FIG. 1 has a pivotally supported jaw 3, which presses with a sole holder 4 the sole of a ski boot 1 against the upper surface of the ski and fixes same thereto. The pivotally supported jaw 3 is furthermore mounted on a base plate 5, which in turn is slidably supported on a pair of rails 6 for movement along the longitudinal axis of the ski 2. The rails 6 are fixedly secured to the ski 2 as by screws. By moving the pivotally supported jaw 3 and the base plate 5 along the rails 6, it is thus possible to adjust the heel-release binding to various boot sizes and to fix it in a desired location for example by means of a not illustrated tooth detent.

Figure 4:
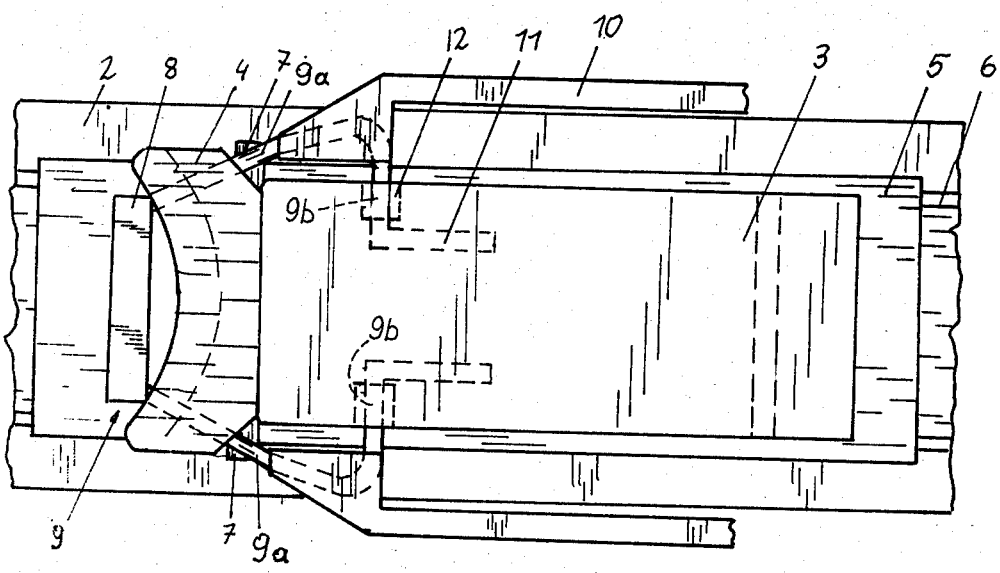
FIG. 4 is a top view of FIG. 3.

The sole of the ski boot 1, which is pressed downwardly by the sole holder 4 against the ski, engages a stepping plate 8 secured to a pair of holding arms 9*a* of a ski brake at one of the ends thereof. The two braking arms 10 of the ski brake, as shown in FIG. 4, are fixedly connected to the holding arms 9*a* at a location spaced from the stepping plate 8. The holding arms 9*a* each has axles 9*b* thereon which are received in bearings 12 on the base plate 5. In addition, the holding arms 9*a* have extensions 11 of the axles 9*b*, which are constructed as torsion springs and are supported on or engage the under surface of the base plate 5. The holding arms and thus the braking arms are initially tensioned through these torsion springs 11 into the braking position. A notch 6A is cut out of each of the rails 6 to facilitate the relative movement between the axles 9*b* and extensions 11 and the rails 6.

FIG. 2 illustrates the pivotally supported jaw 3 in the open position and the ski brake in braking position. The jaw 3 has support flanges 7 which are not, as shown in the drawings, permanently connected to the ski brake, but are engageable with the holding arms 9*a* of the ski brake. If the skier now steps with his ski boot 1 into the binding, then the bottom surface of the sole of the ski boot 1 will press down onto the stepping plate 8 of the ski brake and swing same toward the retracted and downhill position.

Through the inventive arrangement of the support flanges 7, the holding arms 9 of the ski brake will engage the support flanges and the jaw 3 will thereafter be pressed by the holding arms 9 at the same time into the retracted or downhill position, as is shown in FIG. 1.

If now during a fall of the skier only the front jaw is released and the jaw for the heel-release binding remains closed, then based on the inventive coupling of the ski brake with said jaw 3 through the support flanges 7, the ski brake can swing into the braking position, because the support flanges 7 start to function only upon a beginning of the closing of the jaw 3, the holding arms 9 being free to pivot about the axis of the axles **9*b* between the sole holder 4 and the support flanges 7**.

Due to the common support of both the ski brake and also the jaw 3 through a common base plate 5 slidable on the rails 6, a change of the position of the heel-release binding also does not effect a change of the release or braking conditions. A further advantage of the inventive construction lies in that only one stepping plate 8 must be operated which in turn makes stepping into the binding easier.

Of course, a plurality of possible exemplary embodiments are conceivable within the scope of the invention, for example the connection between the operating members 9, namely the holding arms **9*a* and the stepping plate 8, the ski brake and the braking arms could also be constructed in a different manner. Thus, it is possible to couple the holding arms 9*a* with the braking arms 10 through a joint to permit an engagement of the braking arms 10** in direction of travel.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heel-release binding for holding a ski boot on a ski and having a ski brake coupled thereto, said heel-release binding and said ski brake being pivotal about parallel axes, said heel-release binding being pivotal between a ski boot releasing position and a ski boot holding position, said ski brake being pivotal between a retracted downhill position and an extended braking position, the improvement comprising wherein said ski brake has an operating element engaged directly by the sole of said ski boot, wherein said heel-release binding has a support flange thereon and is free of any permanent direct connection to said ski brake, and wherein said ski brake directly engages said support flange during a pivotal movement of said ski brake from the braking position toward said retracted downhill position, said heel-release binding being forcedly moved by said ski brake during said pivotal movement into said ski boot holding position.

2. The heel-release binding according to claim 1, wherein said operating member has at least one holding arm to which is secured braking members, said support flange lying in the path of said pivotal movement of said holding arm and being directly engaged thereby.

3. The heel-release binding according to claim 1, wherein said ski brake and said heel-release binding are mounted on a common base plate supported for longitudinal movement along the longitudinal axis of the ski.

4. In a heel-release binding having a ski brake coupled thereto, said heel-release binding and said ski brake being pivotal about parallel axes, said heel-release binding being pivotal between a ski boot releasing position and a ski boot holding position, said ski brake being pivotal between a retracted downhill position and an extended braking position, the improvement comprising wherein said ski brake has an operating element and braking members connected to said operating element through holding arms, said operating element being directly engaged by the sole of said ski boot, wherein said heel-release binding has a support flange thereon and is free of any permanent direct connection to said ski brake, and wherein said support flange is arranged in the path of said pivotal movement of said holding arm, said holding arm carrying out a pivotal movement during a pivotal movement of said ski brake from said braking position into said downhill retracted position to thereby effect a movement of said heel-release binding toward said ski boot holding position in response to an engagement of said support flange by said holding arm.

* * * * *